US009999566B2

(12) United States Patent
Yli-Kovero

(10) Patent No.: US 9,999,566 B2
(45) Date of Patent: Jun. 19, 2018

(54) SAUNA STOVE LID STRUCTURE AND A SAUNA STOVE EQUIPPED WITH THE LID STRUCTURE

(71) Applicant: Risto Tapio Yli-Kovero, Hämeenlinna (FI)

(72) Inventor: Risto Tapio Yli-Kovero, Hämeenlinna (FI)

( * ) Notice: Subject to any disclaimer, the term of this patent is extended or adjusted under 35 U.S.C. 154(b) by 65 days.

(21) Appl. No.: 15/030,962

(22) PCT Filed: Oct. 22, 2014

(86) PCT No.: PCT/FI2014/050796
§ 371 (c)(1),
(2) Date: Apr. 21, 2016

(87) PCT Pub. No.: WO2015/059357
PCT Pub. Date: Apr. 30, 2015

(65) Prior Publication Data

US 2016/0262976 A1 Sep. 15, 2016

(30) Foreign Application Priority Data

Oct. 22, 2013 (FI) ..... 20130304

(51) Int. Cl.
*A61H 33/06* (2006.01)

(52) U.S. Cl.
CPC ..... *A61H 33/063* (2013.01); *A61H 2033/061* (2013.01)

(58) Field of Classification Search
CPC ..... A61H 33/06
USPC ..... 4/524; 431/75; 123/85 R
See application file for complete search history.

(56) References Cited

U.S. PATENT DOCUMENTS

| | | | | |
|---|---|---|---|---|
| 5,136,734 | A | 8/1992 | Yli-Kovero | |
| 2010/0112499 | A1* | 5/2010 | Ponkanen | A61H 33/063 431/75 |

FOREIGN PATENT DOCUMENTS

| | | | |
|---|---|---|---|
| CA | 732713 | A | 4/1966 |
| CN | 201734953 | U | 2/2011 |
| DE | 297799 | C | 5/1917 |
| DE | 813197 | C | 9/1951 |
| DE | 2205358 | A1 | 8/1972 |

(Continued)

OTHER PUBLICATIONS

The Patent Office of the People's Republic of China, Office Action, Application No. 2014800575331, dated Mar. 23, 2017, 2 pages.

(Continued)

*Primary Examiner* — Lori Baker
(74) *Attorney, Agent, or Firm* — Ziegler IP Law Group, LLC

(57) ABSTRACT

A lid solution of a sauna stove, in which the lid is formed of a lid plate (43) that covers the sauna stove and is made of glass and of a lid frame (44) that positions outside the sauna stove. The lid plate (43) of the sauna stove is broader than an outer mantle (20) of the sauna stove and the frame (44) moves the lid plate (43) through protrusions of the lid plate (43). When closed, the lid plate (43) is on its own weight on top of the stone drum or outer mantle (20) of the sauna stove. The frame (44) is a profile that is open from the front or side and the lid plate (43) of the sauna stove is replaceable without tools by pulling out an old lid plate and pushing in a new in replacement.

20 Claims, 2 Drawing Sheets

(56) References Cited

FOREIGN PATENT DOCUMENTS

| | | | |
|---|---|---|---|
| DE | 19839678 | A1 | 3/2000 |
| FI | 24221 | A | 3/1950 |
| FI | 26179 | A | 2/1953 |
| FI | 26957 | A | 4/1954 |
| FI | 27501 | A | 2/1955 |
| FI | 27623 | A | 4/1955 |
| FI | 37115 | A | 8/1967 |
| FI | 46914 | B | 5/1974 |
| FI | 854753 | A | 6/1987 |
| FI | 81493 | B | 7/1990 |
| FI | 108213 | B | 12/2001 |
| FI | 117041 | B | 5/2006 |
| GB | 14204 | | 10/1913 |
| WO | 02074224 | A1 | 9/2002 |

OTHER PUBLICATIONS

The Patent Office of the People's Republic of China, Search Report, Application No. 2014800575331, dated Mar. 10, 2017, 2 pages.
Written Opinion of the International Searching Authority for Application No. PCT/FI2014/050796, dated Feb. 12, 2015, 6 pages.
International Search Report, Application No. PCT/FI2014/050796, dated Feb. 12, 2016, 6 pages.
Office Action, Finland Patent Office, Application No. 20130304, dated Nov. 3, 2014, 7 pages.
Extended European Search Report received for European Patent Application No. EP14855108.8, dated Jul. 10, 2017, 7 pages.

* cited by examiner

SAUNA STOVE LID STRUCTURE AND A SAUNA STOVE EQUIPPED WITH THE LID STRUCTURE

TECHNICAL FIELD

The present invention relates to a sauna stove lid structure and to a sauna stove

BACKGROUND

Most of sauna stoves with a lid are constructed as presented in FIG. 1. The lid 11 of a sauna stove has a steam opening 12 that is a downwards convergent cone. For closing the lid there is a hatch 13 sized as the steam opening 12 and shaped suitable thereto. The lid covers a stone space 14 of the sauna stove, in which there are stones 15.

In known lid structures of sauna stoves, force transmission organs of a lid lifting mechanism are positioned inside the lid structure or behind the sauna stove. FIG. 2 shows a solution in which at rear part of the lid 21, behind a mantle 20 that forms a stone drum, there is an axle 22 in which an opening arm 23 is fixed and pulling or pushing which arm an opening motor 24 opens or closes the sauna stove.

FIG. 3 shows a known a glass lid equipped sauna stove with a glass lid 31 of a size of the exterior mantle 20 of the sauna stove, which glass lid 31 is pivoted at the rear edge of the sauna stove like a lid of a freezer. For opening the lid, two glass supporters 33 are attached to the lid axle 22. The glass has holes aligned with holes in the supporters and underneath the glass there is a correspondingly holed backing strip 34. The glass remains sandwiched between the supporter and the backing strip. In the axle of the lid there is attached an opening arm 35 with which the opening motor 24 opens or closes the sauna stove.

A disadvantage of this solution is the holes in the glass. The holes are made as a separate processing step in a finished glass. The holes incur costs and form a discontinuity in the glass. The glass is susceptible to fracturing through the holes.

Another disadvantage is caused by thermal expansion of metal. When cold, the holes in the glass and supporters are aligned. When hot, e.g. at 300° C., the supporters stretch and the position of the holes changes. This can be compensated by making large holes in both the glass and supporters so that fixing screws have space for movement. Then the problem is that the glass should not sag but it has to be somehow tightened between the supporters. Then friction may be created between the glass and supporters, which may cause tensions in the glass and break it. Abrasion of the glass against the supporters tightened against it may easily wear in the glass smudgy abrasion marks.

SUMMARY

An objective of the invention is to avoid or mitigate problems relating to the prior art or at least to provide an alternative to known technology. As one objective of the invention it is to avoid or reduce problems caused by thermal expansion of metal by preventing or reducing tensions caused by thermal expansion of metal between parts of the lid and between the lid and sauna stove. An objective is also to reduce costs in manufacturing the lid structure and also in replacing a new lid in place of a broken one.

The inventor has observed that a round lid is well tolerant to thermal expansion of metal. When the opening and the hatch are cones, the hatch apparently ascends and descends with thermal expansion so that the hatch remains tight and no excess tension incurs between the opening and the hatch.

A problem of a hatch of other shape, such as rectangle, is the strong thermal expansion of metal. If a rectangular lid is formed of two plates between which there is an insulator, then the lower plate closer to the stone drum expands more and protrudes downwards so that the lid is no longer tight especially at the corners.

The same applies to a lid made a sole metal plate, which lid protrudes downwards the same way, because the central part heats more than the edges. Other than conical known lid solutions are uninsulated metal plates covering the upper part of the sauna stove and they have bent down edges.

According to a first example embodiment of the present invention there is provided a sauna stove lid of the appended claim 1. In the lid of claim 1, a frame and lid plate can be made substantially separate from each other. Thus the lid plate is not an essential part of the frame structure. This occurs by making the lid plate substantially larger, typically broader, than the body of the sauna stove. The lid plate can be opened and closed along with the lid structure through extensions of the lid plate that extend beyond the body of the sauna stove.

The lid plate frame may form in the plane of the lid plate a substantially L- or U-shaped profile that is open towards the sauna stove. The profile may be uniform or formed of two or more protrusions.

When the lid is closed, an upper surface of a bottom peg of the frame of the lid plate may be lower than the top edge of the mantle of the sauna stove.

A lower surface of a top peg of a U-shaped lid plate frame may be substantially higher than the top surface of the lid plate. The lower surface of the top peg may be at least 10, 20, 30 or 50 mm higher than the top surface of the lid plate.

According to an example embodiment there is provided a sauna stove that comprises a sauna stove according to an example embodiment.

The sauna stove may comprise an opening mechanism of the lid plate, attached to a metallic frame that extends beyond the mantle of the sauna stove.

The sauna stove may comprise an opening organ for opening the lid either manually by a motor. The lid may be attached to the sauna stove with an axle supported to the sauna stove by an axle. The axle may reside, when seen from the top, behind the rear wall of the sauna stove so that the rear part of the body is visible between the axle and the stone space defined by the body. The opening organ may be attached to the frame of the lid in front of the axle of the lid.

BRIEF INTRODUCTION OF DRAWINGS

DETAILED DESCRIPTION

The invention will be described with reference to an applicable embodiment.

Figure 1:
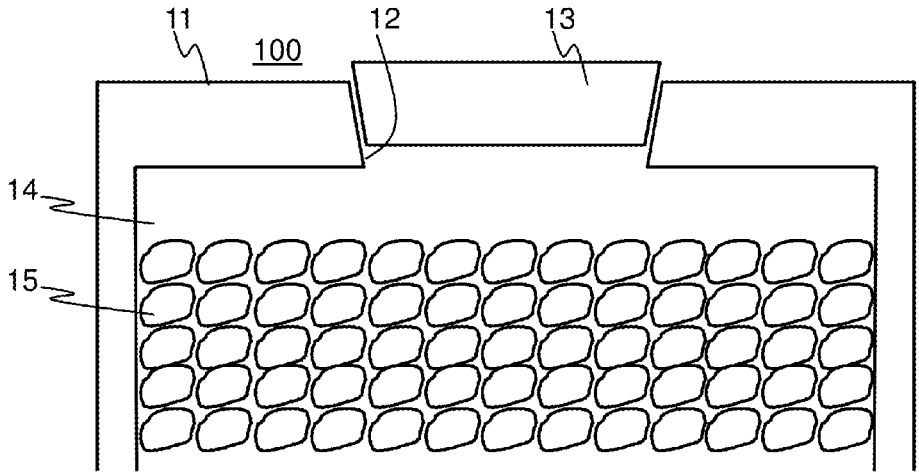
PRIOR ART Fig. 1
FIGS. 1-3 show prior known lid structures of a sauna stove.
Figure 2:
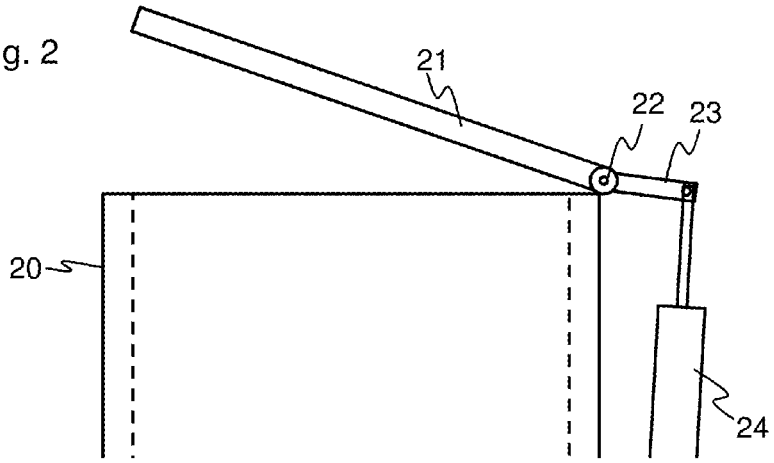
PRIOR ART Fig. 2
Figure 3:
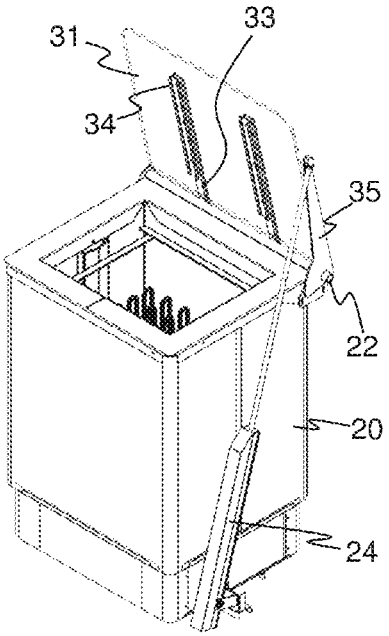
PRIOR ART Fig. 3
Figure 4:
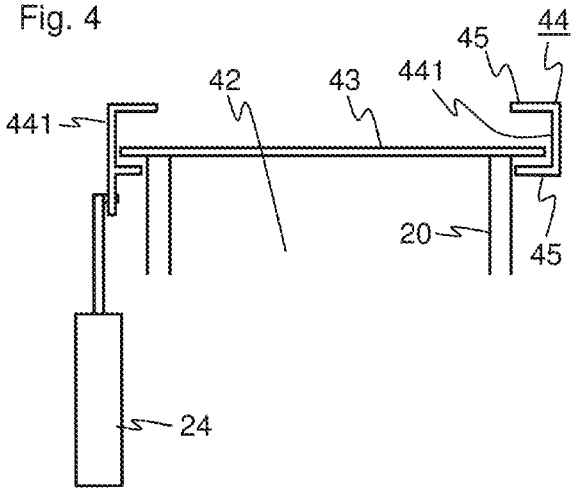
FIG. 4 shows cross-section of a lid structure of a sauna stove according to a useful embodiment, when seen from the front.

FIG. 4 is a cross-section of a lid 50 (FIG. 5) of a sauna stove, seen from the front. On top of an outer mantle 20 of the sauna stove and the stone space 42 there is a lid plate 43 made of glass.

As a moving mechanism of the glass plate there are U-shaped lifting profiles 441 or F-shaped lifting profiles 442, or frames 44, outside a sauna stove mantle. When the lid is closed, the glass plate rests on its own weight on the outer mantle 20 of the sauna stove. An opening of the lifting profile, that is as the frame, is substantially higher than the thickness of the glass plate such that the lid can settle onto the body of the sauna stove without engaging to the upper or lower peg 45 of the profile 441. The lid plate 43 can be made also of two or more parts. The parts of the lid plate may reach to be supported by opposite sides of the frame.

In an embodiment, the top of the sauna stove is formed to comprise a plait or fold and the lid is formed such that the parts of the lid plate settle against the outer mantle of the sauna stove in a gentle upwards or downwards opening V-shape. In this case, the parts of the lid plate are preferably arranged to be removable from the right hand and/or left hand side of the sauna stove when seen from the front (such that the axle remains behind the sauna stove).

The pegs 45 of the profile 441 need not be uniform but the profile 441 may be formed of plural, even point-like parts, that are substantially lined, forming a similar pattern as the pegs 45 of the profile 441. The lifting profile 441 may be also L-shaped, in which case it has no upper peg. This is possible because the glass is by gravity on the lower peg.

Figure 5:
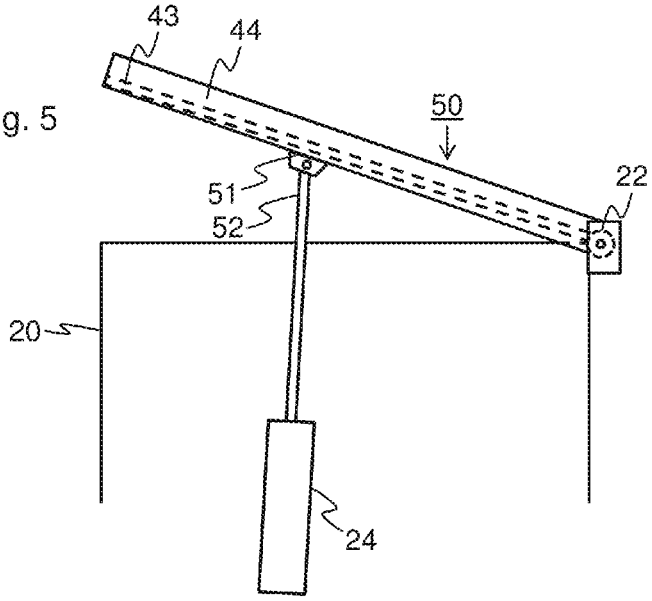
FIG. 5 shows a side view of an opening mechanism of the lid.

FIG. 5 is a side view of an opening mechanism of the lid. In the rear edge of the sauna stove there is a lid axle or pivoting 22 of a frame. The frame 44 has an overhang 51, to which an axle 52 is fixed of an opening motor of the lid that acts as an opening organ 24. The axle opens and closes the lid. The lid plate 43 is on its own weight on a lower peg of the frame 44.

The frame 44 may be rectangular when seen from top, but it can be also of another shape. Preferably, the frame is formed to enable sliding the lid plate 43 into the profile 441 of the frame 44 from one side, such as from front or side. The frame does not necessarily contain any restraint that should be removed or over which the lid plate should be lifted on removal from the profile 441 of the frame 44 even though some embodiments may provide one. A side of the frame may prevent a possible hot air flow between the lid plate 43 and the mantle 20 from directing straight towards an adjacent wall. In an embodiment, there is a detachably attachable side of the frame that covers also a fourth side and that is removable for replacing the glass.

Following advantages are attained by the solution.

The lid is inexpensive to manufacture.

No thermal expansion caused tensions form between glass and metal. The lid plate can be formed of one or more parts. A lid plate originally made of one part can be replaced by two or more parts.

Replacing the glass requires no tools. An old glass is pulled (for example from the front) away and a new one is pushed in replacement.

Play between the frame profile and the lid plate reduces risk of breaking of the lid plate. If, for example, a bather tries to prevent closing of the lid by placing a sauna ladle on the outer mantle of the sauna stove while lid is closing, the linear actuator driving the lid may complete the closing movement thanks to the play without breaking the glass lid.

The replaceable glasses can be dyed and patterned.

The replaceable glasses are easy to remove for cleaning and/or painting of the glasses.

The structure can be used in sauna stoves of all shapes, for example with round sauna stoves when seen from the top.

The structure can be used independent of the method of heating, for example in wood heated and electrically heated sauna stoves.

A lid plate of a sauna stove can be surrounded with the frame on 1-4 sides such that hot air flow directly sideways is prevented from the possible gap between the glass and the mantle and the glass plate floating on the sauna stove can be used with fire safety nearer inflammable wall structures than without a frame that covers a zone under and over the glass plate.

The invention claimed is:

1. A lid for a sauna stove, wherein:

the lid is formed of a lid plate and a lid plate frame;

the lid plate covers a stone drum of the sauna stove;

the lid plate is made of stone, glass, glass ceramic or ceramic material;

the lid plate frame is outside an inner mantle of the sauna stove when closed; and the lid plate frame is made of a metal.

2. The lid of claim 1, wherein the frame of the lid plate forms a profile that opens in the plane of the lid plate towards the interior of the frame i.e. towards the sauna stove.

3. The lid of claim 2, wherein the profile formed by the frame of the lid plate is L- or U-shaped.

4. The lid of claim 2, wherein the profile is uniform.

5. The lid of claim 2, wherein the profile is formed of two or more overhangs.

6. The lid of claim 1, wherein the lid plate is formed of two or more parts.

7. A sauna stove, wherein the sauna stove comprises a lid of claim 1.

8. The sauna stove of claim 7, wherein the lid plate covers an area greater than the outer mantle of the sauna stove and the lid plate frame is outside the outer mantle.

9. The sauna stove of claim 7, wherein when the lid is closed, an upper surface of a bottom peg of the frame of the lid plate is lower than the top surface of the outer mantle of the sauna stove.

10. The sauna stove of claim 7 wherein when the lid is closed, a lower surface of a top peg of a U-shaped lid plate frame is substantially higher than the top surface of the lid plate.

11. The sauna stove of claim 7, wherein the sauna stove comprises an opening organ for opening the lid either manually or by a motor and in that the opening organ is attached to the frame of the lid on front side of an axle of the lid.

12. The lid of claim 3, wherein the profile is uniform.

13. The lid of claim 3, wherein the profile is formed of two or more overhangs.

14. The lid of claim 2, wherein the lid plate is formed of two or more parts.

15. A sauna stove, wherein the sauna stove comprises a lid of claim 2.

16. A sauna stove, wherein the sauna stove comprises a lid of claim 3.

17. A sauna stove, wherein the sauna stove comprises a lid of claim 13.

18. The sauna stove of claim 15, wherein the lid plate covers an area greater than the outer mantle of the sauna stove and the lid plate frame is outside the outer mantle.

19. The sauna stove of claim 15, wherein when the lid is closed, an upper surface of a bottom peg of the frame of the lid plate is lower than the top surface of the outer mantle of the sauna stove.

20. The sauna stove of claim 15, wherein the sauna stove comprises an opening organ for opening the lid either manually or by a motor and in that the opening organ is attached to the frame of the lid on front side of an axle of the lid.

* * * * *